United States Patent [19]

Swiech et al.

[11] Patent Number: 4,840,120

[45] Date of Patent: Jun. 20, 1989

[54] PRINTER FOR A STRIP OF TICKETS

[75] Inventors: Matthew J. Swiech, Antioch; Gary D. Munyon; Kenneth J. Dias, both of Concord, all of Calif.

[73] Assignee: G & B Rubber Stamp Co., Inc., Concord, Calif.

[21] Appl. No.: 51,298

[22] Filed: May 18, 1987

[51] Int. Cl.[4] ..... B41F 5/04

[52] U.S. Cl. ..... 101/228; 101/349; 226/199

[58] Field of Search ..... 101/66, 216, 234, 235, 101/349, 36, 228; 226/199

[56] References Cited

U.S. PATENT DOCUMENTS

| | | | |
|---|---|---|---|
| 290,329 | 12/1883 | Hoffmann | 101/36 |
| 394,274 | 12/1888 | Ide | 101/349 |
| 520,698 | 5/1894 | McElreth | 101/234 |
| 597,981 | 1/1898 | Holmes | 101/234 |
| 1,702,763 | 2/1929 | Clark | 101/234 |
| 1,957,291 | 5/1934 | Rees | 101/228 |
| 2,134,379 | 10/1938 | Sauerman | 101/234 |
| 2,211,792 | 8/1940 | Rohland | 101/36 |

FOREIGN PATENT DOCUMENTS

| | | | |
|---|---|---|---|
| 1000601 | 7/1952 | France | 101/235 |

*Primary Examiner*—Clifford D. Crowder
*Attorney, Agent, or Firm*—Ernest M. Anderson

[57] ABSTRACT

An imprinter for use in applying numbers, names or other indicia upon tickets comprises a motor driven roller; a floating axle that supports a friction roller, an imprint roller and an inking wheel; and guide structure for processing a stack of accordion folded tickets through the imprinter and depositing imprinted tickets into a second stack.

5 Claims, 2 Drawing Sheets

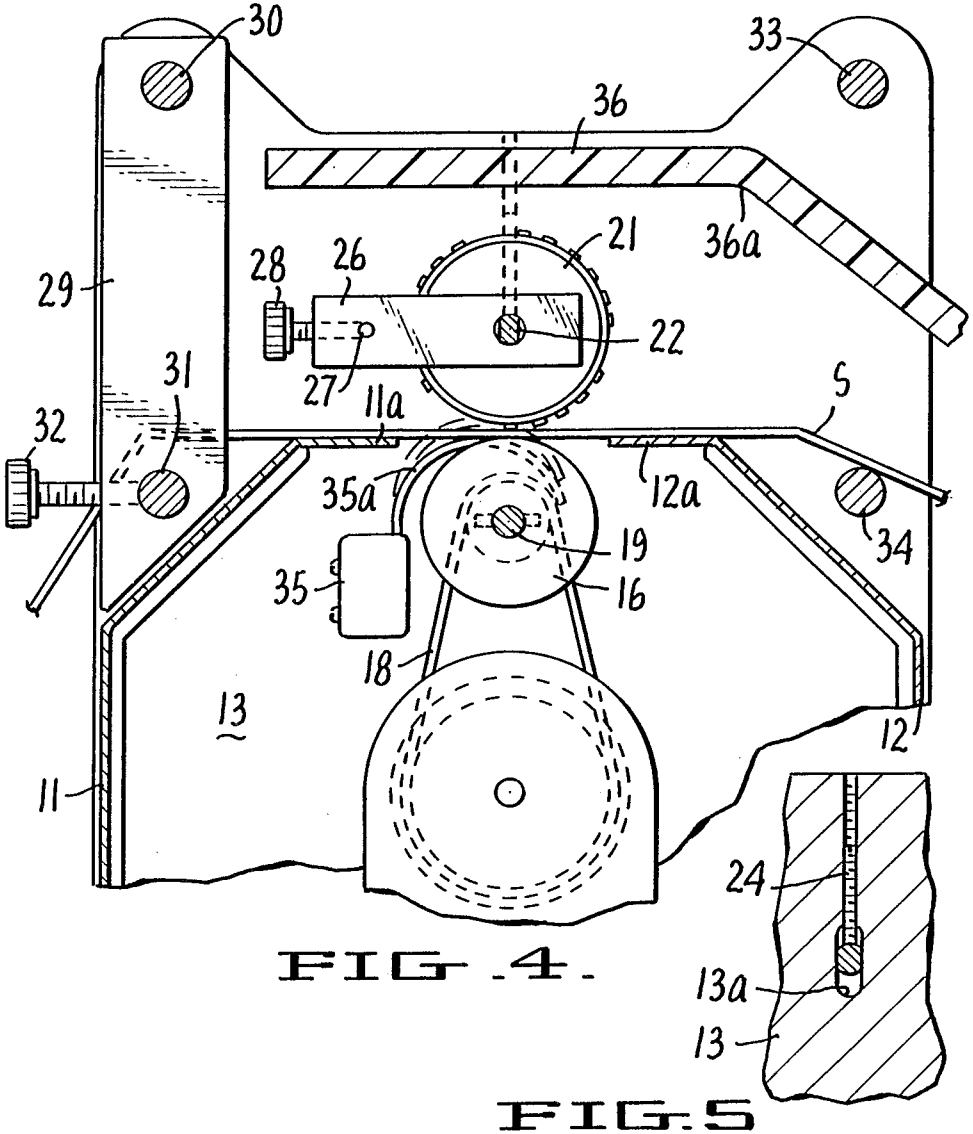
FIG. 4
FIG. 5
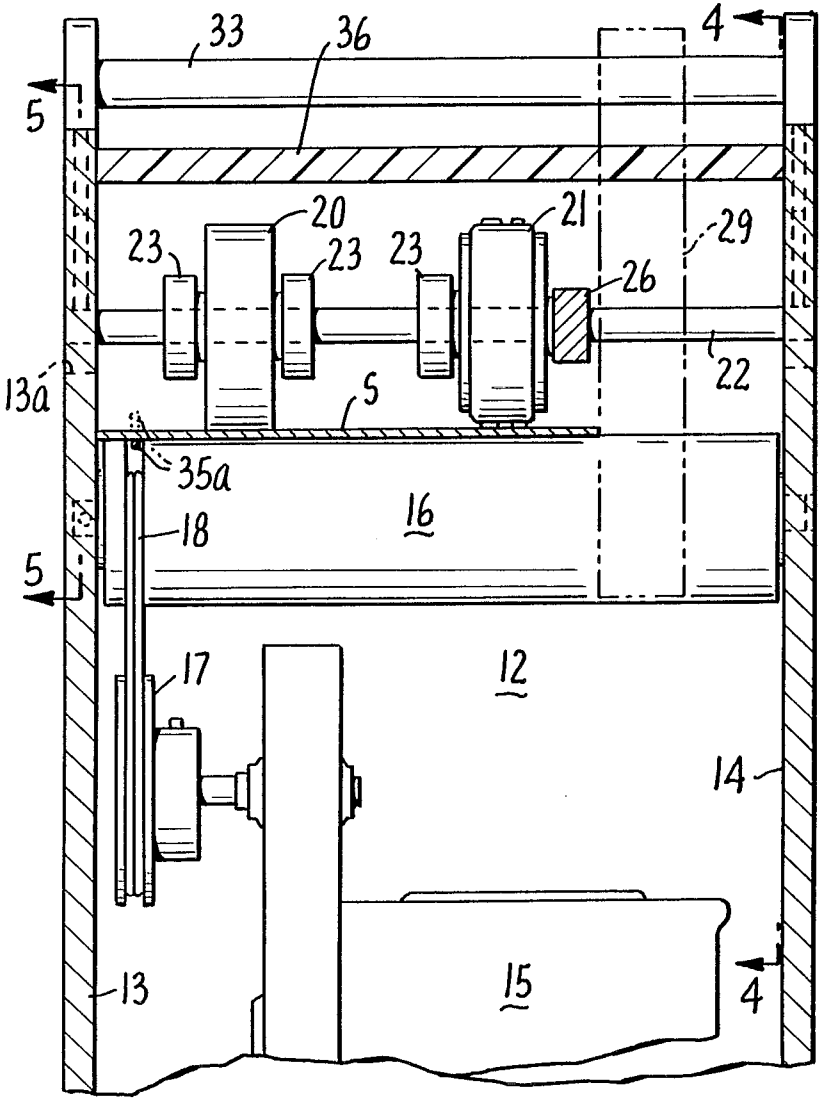
FIG. 3

PRINTER FOR A STRIP OF TICKETS

SUMMARY OF THE INVENTION

This invention relates generally to imprint apparatus, principally for use in imprinting tickets with numbers, names or other identifying indicia. A principal object of the invention is to provide a compact imprinter that will automatically unstack, print and restack tickets rapidly and efficiently. The invention further provides an imprinter that is adjustable for tickets of varying size and thickness, a removable inking pad that is easily changeable and an imprinter that is compact, lightweight and portable.

The imprinter of the present invention essentially comprises a rectangular housing and support frame for a drive motor and a motor driven roller that extends across the width of the housing. A protective shield is provided but having an opening directly above or over the roller, the upper peripheral surface of said roller projecting through the opening. Imprint and friction rollers are independently mounted for rotation upon a floating axle which may be vertically adjusted. The peripheral surfaces of both rollers are brought into close proximity or contact with the upper periphery of the driven roller so that a strip of tickets fed therebetween will be advanced by the driven roller while simultaneously imprinting indicia carried on the imprint roller.

An inking wheel peripherally engaged with the imprint roller is mounted from an arm secured to the floating axle; and guide means is provided for aligning and directing a strip of tickets between the driven rollers and the friction and imprint rollers.

Various objects of the invention, in addition to those stated above, will become apparent in view of the following detailed description and the accompanying drawings.

DESCRIPTION OF THE DRAWINGS

In the drawings forming a part of this application and in which like parts are identified by like reference numerals.

FIG. 3 is a partial elevation and section viewed on lines 3—3 of FIG. 1;

FIG. 4 is an elevation and partial section viewed on lines 4—4 of FIG. 3; and FIG. 5 is an enlarged detail and section taken on lines 5—5 of FIG. 3.

DETAILED DESCRIPTION

Figure 1:
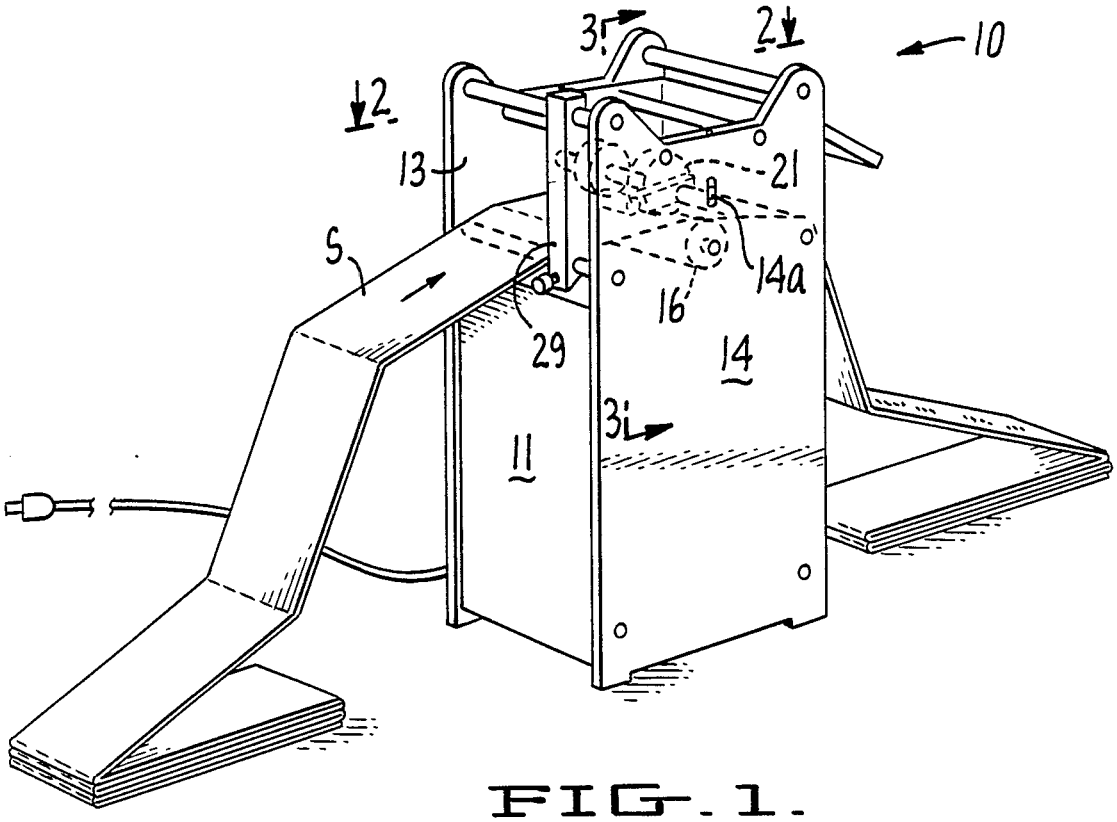
FIG. 1 is a perspective view of a preferred embodiment of an imprinter.
Figure 2:
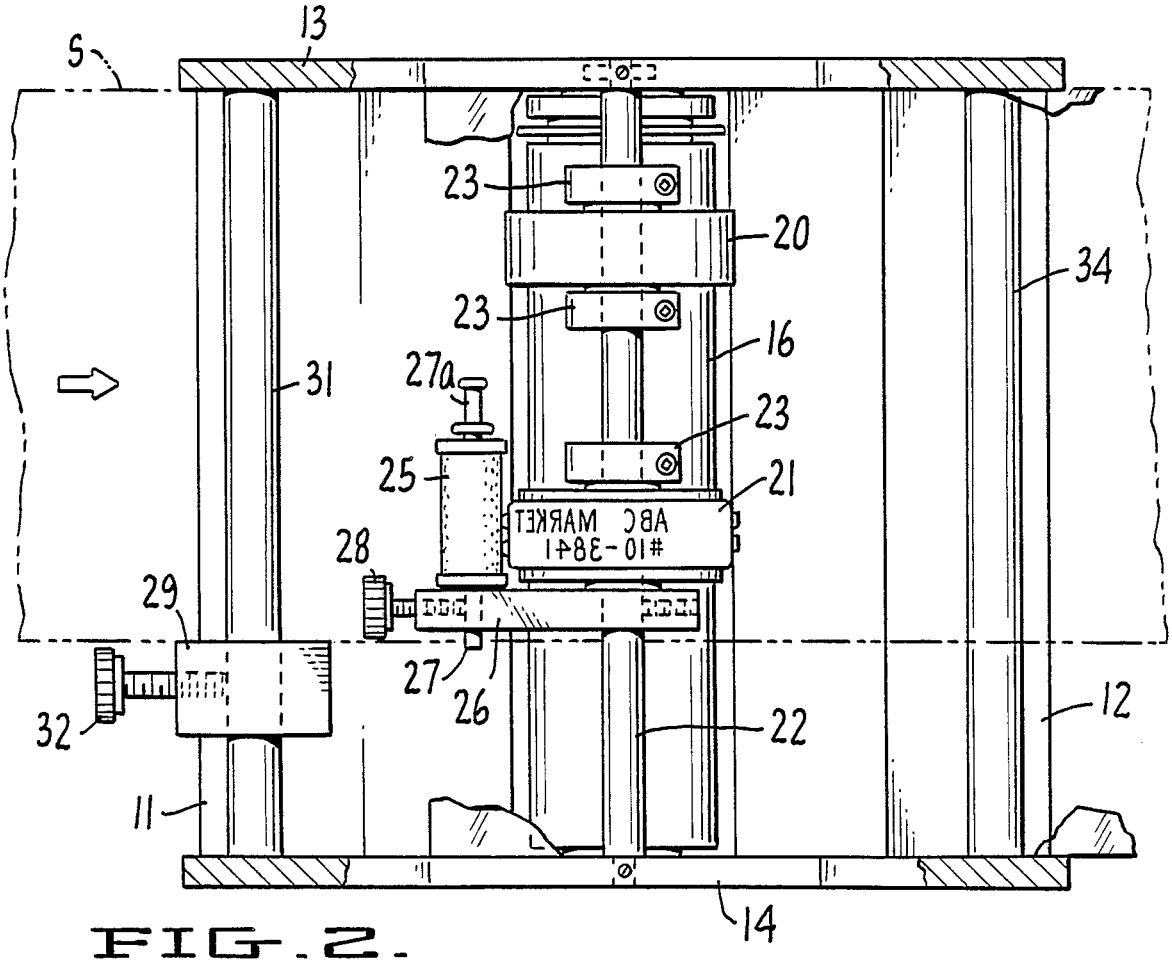
FIG. 2 is a plan view of the imprinter viewed on lines 2—2 of FIG. 1.

Referring to FIG. 1, there is shown a preferred embodiment of the invention in an imprinter 10 comprising a rectangular housing and support frame including a front plate 11, a rear plate 12 and side plates 13 and 14. An electric drive motor 15 is mounted within the housing and drives an elongated roller 16 through a pulley 17 and a pair of polycore belts 18. Roller 16 spans substantially the full distance between side plates 13 and 14 and is rotatably mounted on a shaft 19, conventional bushings (not shown) being secured within the ends of roller 16 to provide a relatively friction free rotation.

Referring to FIG. 5, front and rear plates 11 and 12 are each formed with upper angular extensions 11*a* and 11*b* which extend over and shield the upper peripheral surface of roller 16. However, the upper peripheral surface of roller 16 actually projects above an opening defined between extensions 11*a* and 12*a* to an extent that a strip of tickets S, supported on the upper surfaces of extensions 11*a* and 12*a*, will come into contact with the upper periphery of roller 16.

A friction roller 20 and an imprint roller 21 are rotatably mounted independently of the other upon a floating axle 22 which "floats" in the sense that it moves vertically in vertical ways or openings 13*a* and 14*a* formed in side plates 13 and 14. Both friction roller 20 and imprint roller 21 are mounted upon axle 22 by bearings 23, which are axially adjustable. This construction allows imprint roller 21 to be adjusted axially for imprinting indicia at various locations across the tickets. Also, adjustments in the axial position of roller 20 allows it to be positioned so that the drive force on the tickets is balanced so that the tickets travel through the machine in a straight line. The ends of axle 22 are engaged by threaded machine screws 24 which may be adjusted vertically upward or downward. A downward adjustment increases the pressure applied between rollers 20,21 and drive roller 16.

Means is also provided for continuously inking imprint roller 21. An inking wheel 25, engaged with imprint roller 21, is supported upon arm 26 which is secured to floating axle 22. Wheel 25 is rotatably mounted to arm 26 upon a pin 27, said pin having a finger engageable extension 26*a* outboard of wheel 25. Pin 27 is affixed to arm 26 by means of a set screw 28.

A guide means is provided for aligning and directing a strip of tickets between rollers 20,21 and roller 16. More specifically, a vertical guide bar 29 is mounted upon a pair of horizontal support posts 30 and 31 which are vertically spaced apart, the lowermost post being lower than the lower peripheral surfaces or rollers 20,21, the upper post 30 being substantially above rollers 20 and 21. Guide bar 29, it will be understood, is horizontally adjustable along posts 30 and 31 to accommodate ticket strips of various widths. A set screw 32 engages lower post 31 for retaining bar 29 in a set position.

An additional functional feature of post 30 is that it is accessible from above the imprinter and may serve as a handle for transport. Post 31 also functions as a support guide for tickets as they are fed through the imprinter. Corresponding posts 33 and 34 are provided on the rear side of the apparatus. Post 33 may also be used as a handle for transport purposes and post 34 serves as a support guide for tickets discharged following imprinting.

Motor 15 is automatically energized and operated as soon as strip material is fed between drive roller 16 and the friction and imprint roller 20,21. This is accomplished by a switch 35 having an arcuate trigger arm 35a that is contacted by the lead end of strip material as it is fed between rollers. The switch is activated as arm 35a is depressed.

A transparent cover 36 having an angular bend 36a is provided to deflect imprinted tickets downward. Cover 36 is mounted to the housing above the friction and imprint rollers and below posts 30 and 33.

Although a preferred embodiment of the invention has been illustrated and described, various modifications and changes may be resorted to without departing from the spirit of the invention or the scope of the appended claims, and each of such modifications and changes is contemplated.

What is claimed is:

1. An imprinter for use in applying numbers, names or other indicia upon tickets, comprising:

a rectangular housing and support frame including front, rear and side plates, each side plate having an elongate slot formed therein;

a drive motor and an elongate roller mounted within said rectangular housing and support frame; said roller being mounted between said side plates on a first horizontal axis and operatively connected to said motor;

a non-rotating floating axle of support mounted between said side plates on a second horizontal axis parallel to and above said first horizontal axis, the ends of said floating axle being engaged with the elongate slots, respectively;

means for engaging the ends of said floating axle for vertically positioning said axle relative to said first horizontal axis;

a friction roller rotatably mounted and supported upon said floating axle, the peripheral surface of said friction roller being in close proximity or in contact with the upper periphery of said elongate roller;

an imprint roller rotatably mounted and supported upon said floating axle, the peripheral surface of said imprint roller being in close proximity or in contact with the upper periphery of said elongate roller;

an inking wheel and mounting arm, said arm being secured to said floating axle, said wheel being rotatably mounted from said arm and peripherally engaged with said imprint roller; and guide means for aligning and directing a strip of tickets between said drive roller and said friction and imprint rollers.

2. The imprinter of claim 1, said inking wheel being rotatably mounted to said mounting arm upon a pin, said pin being fixedly mounted to said mounting arm at one end and having a finger engageable extension outboard of said inking wheel at the other end; and a set screw for securing said pin to said mounting arm.

3. The imprinter of claim 1, said friction and said imprint rollers each being mounted independently of the other upon said floating axle.

4. An imprinter for use in applying numbers, names or other indicia upon tickets, comprising:

a rectangular housing and support frame including front, rear and side plates;

a drive motor and an elongate roller mounted within said rectangular housing and support frame; said roller being mounted between said side plates on a first horizontal axis and operatively connected to said motor;

a non-rotating floating axle of support mounted between said side plates on a second horizontal axis parallel to and above said first horizontal axis;

a friction roller rotatably mounted and supported upon said floating axle, the peripheral surface of said friction roller being in close proximity or in contact with the upper periphery of said elongate roller;

an imprint roller rotatably mounted and supported upon said floating axle, the peripheral surface of said imprint roller being in close proximity or in contact with the upper periphery of said elongate roller;

an inking wheel and mounting arm, said arm being secured to said floating axle, said wheel being rotatably mounted from said arm and peripherally engaged with said imprint roller; and guide means for aligning and directing a strip of tickets between said elongate roller and said friction and imprint rollers;

and further comprising a pair of horizontal support posts mounted between said side plates and vertically spaced apart, the lowermost post being lower than the lower peripheral surface of said imprint roller, the other post being above the upper peripheral surface of said imprint roller; said guide means comprising a bar adjustably supported upon said pair of support posts and horizontally positionable therealong.

5. An imprinter for use in applying numbers, names or other indicia upon tickets, comprising:

a rectangular housing and support frame including front, rear and side plates;

a drive motor and elongate roller mounted within said rectangular housing and support frame, said roller being mounted between said side plates on a first horizontal axis and operably connected to said motor;

a non-rotating floating axle of support mounted between said side plates on a second horizontal axis parallel to and above said first horizontal axis;

an imprint roller rotatably mounted and supported upon said floating axle, the peripheral surface of said imprint roller being in close proximity or in contact with the upper periphery of said elongate roller;

means for rotating said imprint roller in response to rotation of said elongate roller;

and guide means for aligning and directing a strip of tickets between said elongate roller and said imprint roller and further comprising a pair of horizontal support posts mounted between said side plates and vertically spaced apart, the lower most post being lower than the lower peripheral surface of said imprint roller, the other post being above the upper peripheral surface of said imprint roller, said guide means comprising a bar adjustably supported upon said pair of support posts and horizontally positionable therealong.

* * * * *